United States Patent [19]

Deane et al.

[11] Patent Number: 4,794,994

[45] **Date of Patent: * Jan. 3, 1989**

[54] DRAG DRILL BIT HAVING IMPROVED FLOW OF DRILLING FLUID

[75] Inventors: John D. Deane; Percy W. Schumacher, both of Houston, Tex.

[73] Assignee: Reed Tool Company, Houston, Tex.

[ * ] Notice: The portion of the term of this patent subsequent to Jul. 28, 2004 has been disclaimed.

[21] Appl. No.: 30,123

[22] Filed: Mar. 26, 1987

[51] Int. Cl.[4] ..... E21B 10/46; E21B 10/60

[52] U.S. Cl. ..... 175/329; 175/393; 175/394

[58] Field of Search ..... 175/329, 339, 340, 393, 175/394, 417, 418, 424, 400

[56] References Cited

U.S. PATENT DOCUMENTS

| | | | |
|---|---|---|---|
| 3,220,497 | 11/1965 | Mori | 175/393 |
| 4,116,289 | 9/1978 | Feenstra | 175/329 |
| 4,246,977 | 1/1981 | Allen | 175/329 |
| 4,350,215 | 9/1982 | Radtke | 175/329 |
| 4,452,324 | 6/1984 | Jurgens | 175/393 |
| 4,460,053 | 7/1984 | Jurgens et al. | 175/329 |
| 4,471,845 | 9/1984 | Jurgens | 175/329 |
| 4,682,663 | 7/1987 | Daly et al. | 175/329 |

*Primary Examiner*—Stephen J. Novosad
*Assistant Examiner*—Bruce M. Kisliuk
*Attorney, Agent, or Firm*—Dodge, Bush & Moseley

[57] ABSTRACT

A drag type rotary bit (10) having polycrystaline diamond compact (PDC) cutting elements arranged in a plurality of rows extending from the center of the bit body (12) to the outer peripheral surface (20) thereof. A fluid discharge nozzle (38A-38F) is provided for each row of cutting elements (36A-36G) and has a fluid discharge stream (62) directed downwardly against the bore hole bottom (66) and opposite the direction of rotation of the bit (10) ahead of the associated row of cutting elements (36A-36G) for flowing against the cutting faces (53) of the cutting elements (36A-36G) after impingement of the bore hole bottom (66).

15 Claims, 3 Drawing Sheets

DRAG DRILL BIT HAVING IMPROVED FLOW OF DRILLING FLUID

BACKGROUND OF THE INVENTION

This invention relates generally to drag type rotary drill bits and more particularly to improvements in the arrangement of cutting elements and fluid discharge orifices on the face of the drill bit for obtaining a highly effective flow of drilling fluid against the cutting elements for the cleaning and cooling thereof.

It has become common practice to dress drag type rotary well drilling bits with cutting elements made of man made polycrystalline diamond compacts or cutters projecting from the bit body. This technology has allowed diamond cutting elements to be formed and shaped into more desirable cutting edges and has further provided higher strength diamonds allowing cutting edges to project a maximum distance from the bit body. One polycrystalline diamond cutting structure in common use has been what is commonly referred to as polycrystalline diamond compact (PDC) which is a small carbide plate with a thin layer of polycrystalline doamond bonded to one face. This has resulted in PDC type diamond drill bits capable of drilling more efficiently in softer formations than was possible with the natural diamonds used in earlier diamond bits.

The use of these PDC type diamond drill bits has also had resultant undesirable increased problems associated with heat degradation and "balling". Balling is a build up of formation chips or cuttings on the bit face or the hole bottom and is caused by sticky formations, such as sticky shales or similar formations having a large percentage of clays, adhering to the cutting face of the bit. This balling condition not only deters drilling, but it also causes rapid heat deterioration of the cutting elements due to poor circulation and decreased cutting efficiency.

This balling condition occurs primarily when using water based muds which cause a swelling of the clays. It is highly desirable to provide a bit dressed with these PDC type cutting elements which has the versatility to not only drill efficiently in soft, sticky formations when using water base muds, but also remain effective and durable when harder formations are encountered.

U.S. Pat. No. 4,499,958 discloses a deep bladed design for a drill bit using PDC type cutting elements but this design would appear to have a limited cleaning effect for the edges of the cutting elements. Also, this type bit may be subjected to considerable wear and breakage when harder formations are encountered because of the relatively small number of cutting elements and the relatively long projection of the cutting elements from the adjacent bit body or blade.

U.S. Pat. No. 4,505,342 discloses a PDC type drill bit which has a high density of cutting elements, and has fluid nozzles directed at the well bore bottom. After the fluid impinges the well bore bottom a portion of the fluid flows at relatively low velocity through the fluid channels directing it in fron of rows of cutting elements in an attempt to adequately flush all of the cutting elements and clean the hole bottom. The fluid velocity resulting in these channels is too low, however, for providing adequate cleaning of the cutting elements when drilling soft sticky formations with water base muds and prevent balling.

In other attempts to solve this severe cleaning problem resulting from soft sticky formations, U.S. Pat. Nos. 4,452,324; 4,471,845; 4,303,136; and 4,606,418 have disclosed PDC type diamond drill bits with relatively large numbers of nozzle orifices in the bit in an attempt to adequately clean all of the cutting elements on the bit. However, fi the velocity and total orifice area are maintained, a large number of nozzle orifices will result in orifices of a small area and this will increse the probability of clogging of some of the nozzle orifices. A reduced velocity will result in the event the total orifice area for the bit is increased and this likewise will increase the probability of clogging of the nozzle orifices.

SUMMARY OF THE INVENTION

The present invention discloses a drag type rotary drill bit with unique positioning of cutting elements and fluid discharge orifices so that an improved flow of drilling fluid is provided against a plurality of cutting elements from a single orifice. This improved flow of drilling fluid against the cutting elements is designed to permit a highly effective cleaning and cooling of the cutting elements and efficient drilling with water base mud in soft sticky formations, while providing sufficient cutting elements and discharge orifices for the effective penetration of harder formations.

Briefly the drag type rotary drilling bit of this invention comprises a generally cylindrical bit body having cutting elements mounted on the cutter head, each having a planar cutter face and projecting downwardly from the head to a cutting edge engageable with the well bore bottom. Preferably these cutting elements are PDC type cutting elements positioned on the cutter head in a plurality of rows. Each row of cutting elements preferably is in the form of a spiral emanating from the axis of rotation and extending in a trailing direction with regard to the direction of rotation of the bit. This arrangement permits the use of more cutting elements in the gage or outer peripheral area of the bit for improved cutting.

At least one nozzle is associated with each row of cutting elements and is positioned ahead of the respective row in the direction of rotation of the bit. A relatively small number of nozzle orifices is desirable because it permits relatively large diameter ports to form the orifices thereby reducing the possibility of clogging of the orifices. Each nozzle for a respective row directs fluid under pressure to flow opposite the direction of rotation of the bit and in a downward conical flow pattern stream to an area of impingement on the well bore bottom ahead of the respective row of cutting elements, with the fluid flowing from the area of impingement in a lateral divergent stream impinging substantially all of the cutting elements in the row. Preferably the stream of drilling fluid flowing from the area of impingement on the well bore bottom does not diverge substantially beyond the innermost and outermost cutting elements of the respective row prior to impinging the cutting elements. With this arrangement, the portion of the well bore bottom immediately in the path of the cutting elements is cleaned of cuttings and the cutting elements are thereafter washed clean of cuttings and adequately cooled by the stream of drilling fluid as the cuttings are formed.

Thus, the present invention is particularly directed to the positioning of the cutting elements and fluid discharge orifices so that a single orifice is utilized for a plurality of cutting elements arranged in a row and radially spaced successively outwardly from the axis of rotation of the drill bit. The center of the volume of fluid being developed from a fluid discharge orifice which is the center of the jet formed by the discharged drilling fluid is directed against the well bore bottom immediately in the path of the row of cutting elements covered by the orifice and in a direction against or opposed to the directin of rotation of the bit. After impingement on the well bore bottom the discharged fluid forms a diverging stream and the cutting elements and orifice are positioned so that the stream impinges a predetermined plurality of cutting elements in a row in a laterally divergent flow generally normal to the cutting faces of the cutting elements. Such a prearranged positioning of the cutting elements and orifices causes a high fluid energy to impinge the cutting faces and results in a highly effective cleaning and cooling action for the cutting elements thereby providing an increased rate of penetration for the drill bit.

It is an object of the present invention to provide a PDC type rotary drag drilling bit with the versatility to drill sticky formations with water base mud and yet provide an effective penetration of harder formations when encountered.

A further object is to minimize in such a drag type drill bit the number of nozzles used thereby reducing the chance of nozzle clogging while adequately cleaning all of the cutting elements.

Still another object is to provide a drag bit with the PDC type cutting elements arranged in a relatively few number of rows each having an increased number of cutting elements in the gage area of the bit.

Another object is to provide a rotary drag drill bit with the cutting elements and fluid discharge orifices being so positioned that a discharge orifice is associated with a row of cutting elements and discharges drilling fluid in such a manner as to cause high energy fluid to impinge the faces of a plurality of cutting elements to improve cleaning and cooling of the cutting elements.

Other objects, features, and advantages of this invention will become more apparent after referring to the following specification and drawings.

DESCRIPTION OF THE INVENTION

Figure 1:
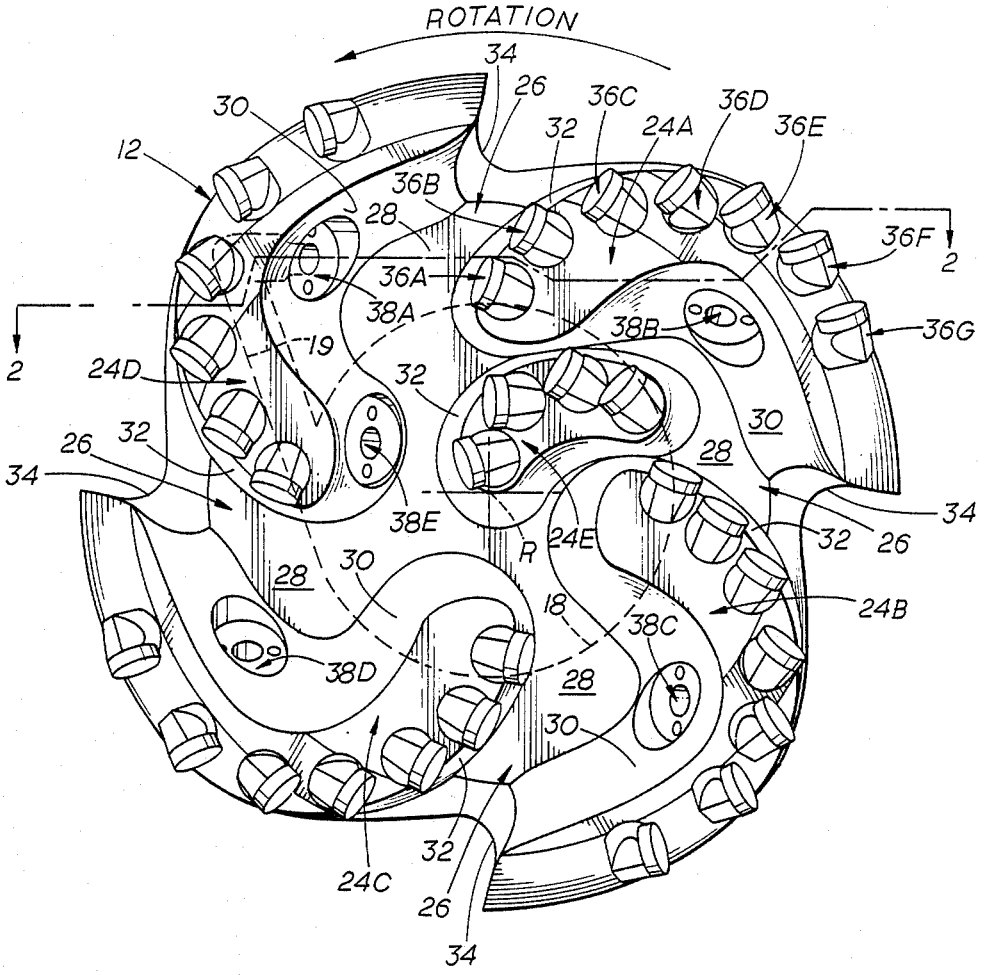
FIG. 1 is a bottom plan of the drag drill bit forming this invention and illustrating rows of cutting elements projecting from the outer face thereof.
Figure 2:
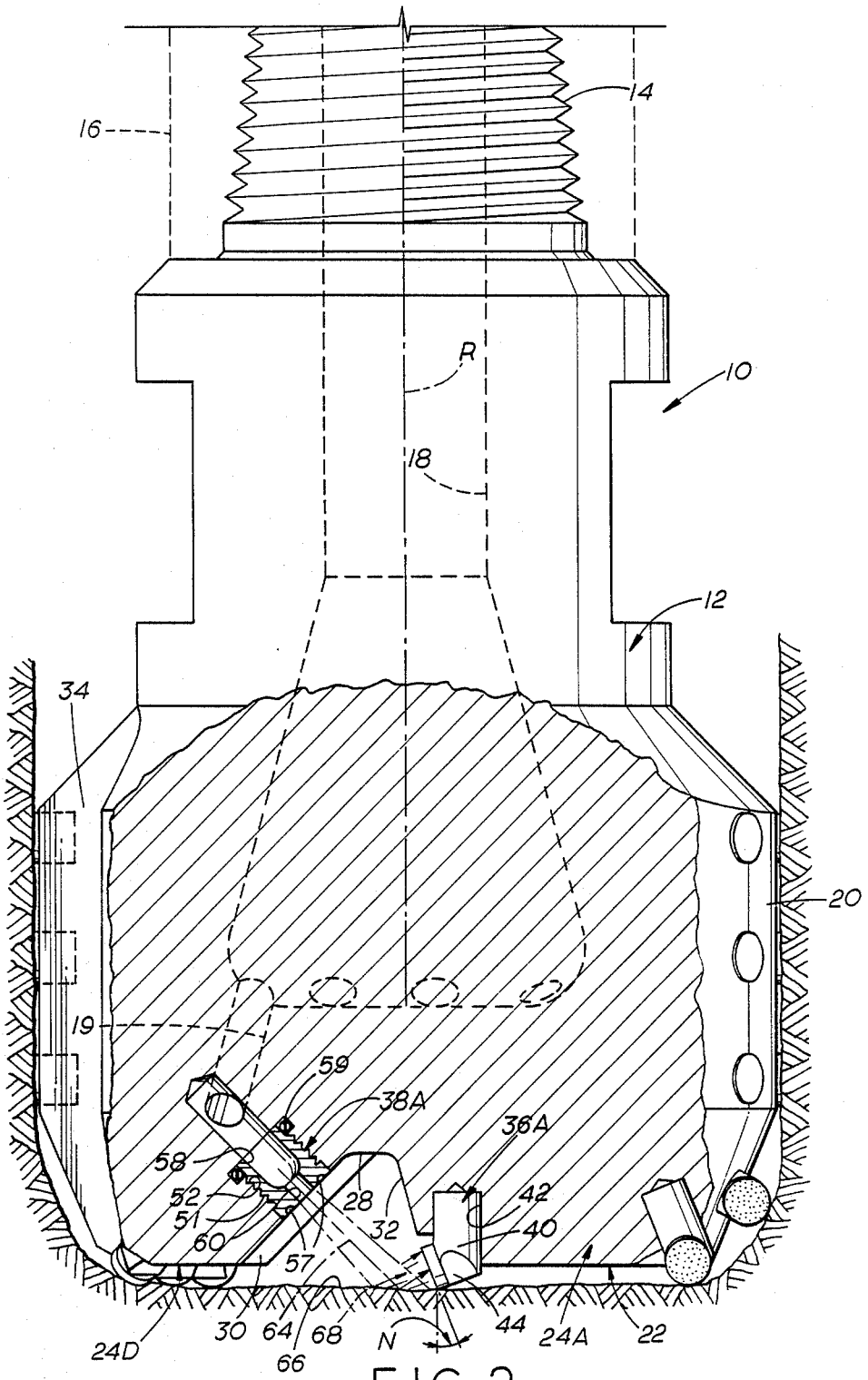
FIG. 2 is a section taken generally along line 2—2 of FIG. 1 but showing the drill bit partly in elevation.
Figure 3:
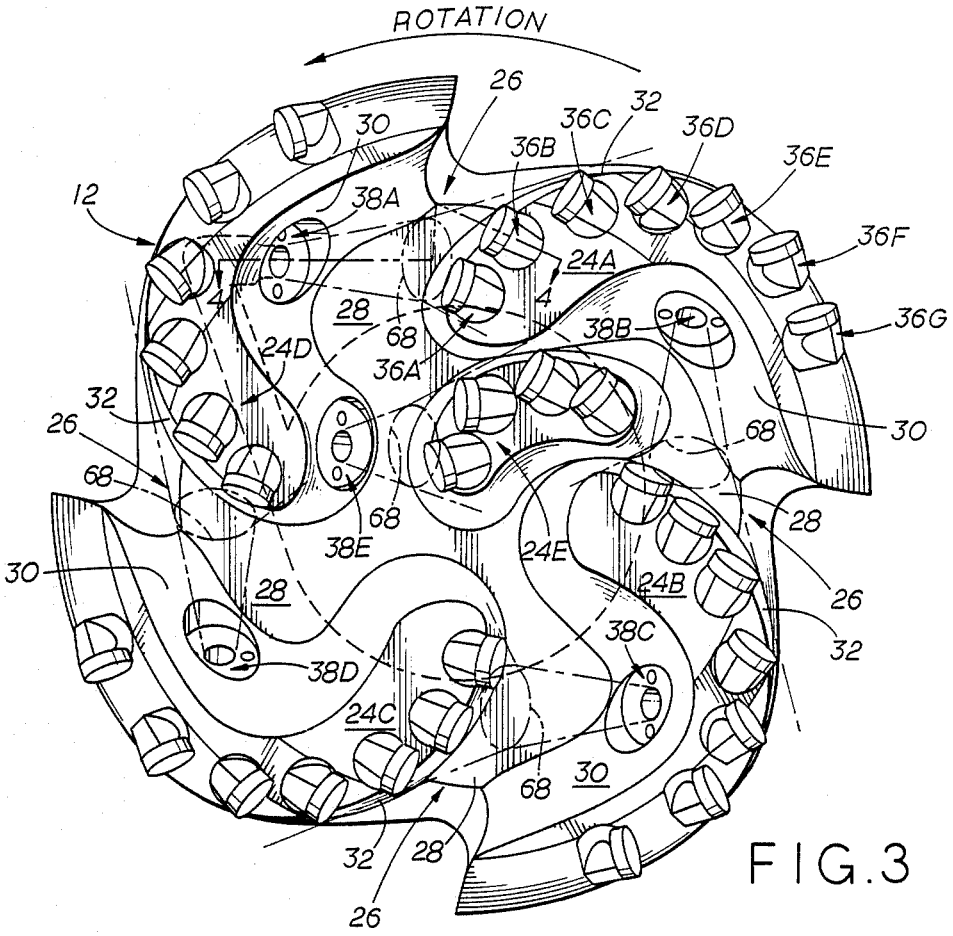
Figure 4:
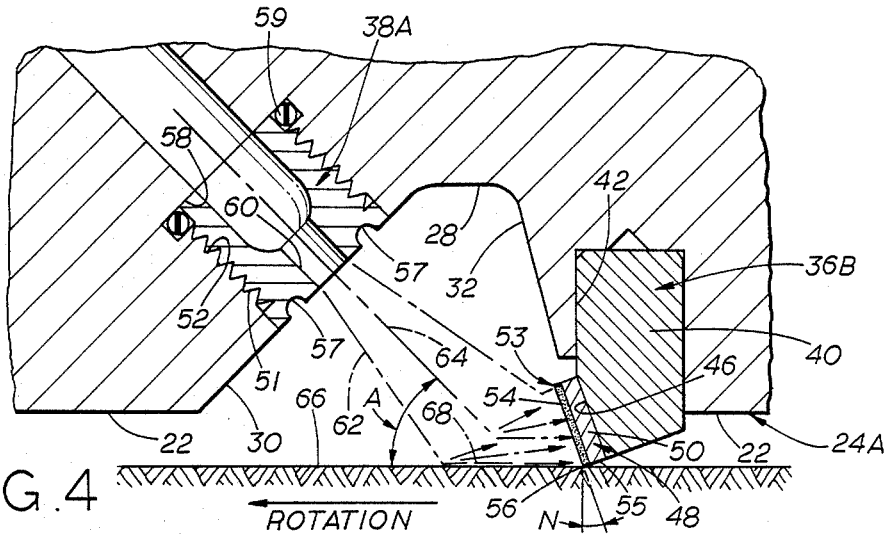

FIG. 3 is a view similar to FIG. 1 but showing particularly the streams of drilling fluid being discharged from discharge nozzles against the bore hole bottom and planar faces of associated adjacent cutting elements in the plurality of rows; and FIG. 4 is an enlarged fragment of FIG. 2 showing a discharge nozzle and associated cutting element with the centerline of the fluid jet or stream from the nozzle impinging the well bore bottom ahead of the cutting element with respect to the rotation of a drill bit.

Referring particularly to FIGS. 1-3, a drag type rotary drill bit is shown generally at 10 having a generally cylindrical bit body 12 with an externally threaded pin 14 at its upper end. Pin 14 is threaded within the lower end of a drill string indicated generally at 16 which is suspended from a drill rig at the surface for rotating drill bit 10. Drill bit boty 12 has a longitudinally extending main fluid passage 18 which is adapted to receive drilling fluid or mud from the drill rig for the drilling operation and a branch line or passage 19 leads from passage 18. Bit body 12 has an outer peripheral surface 20 forming the outer gage thereof and a lower face or surface 22 which forms a suitable crown. It is to be understood that bit body 12 can be formed with various types of crown designs for the face of the bit body depending for example, on such factors as the type of formation or the mud program proposed for the formation. Bit body 12 may be formed of any suitable material, such as various types of steel or cast tungsten carbide.

Projecting from lower surface 22 are a plurality of curved ribs or projections 24A, 24B, 24C, 24D, and 24E. Ribs 24A-24E extend from the center of the axis of rotation located at R. Grooves generally indicated at 25 are formed between adjacent ribs 24A-24E and provide channels for the flow of cuttings and drilling fluid. Grooves 26 define bottom surfaces at 28, sloping side surfaces 30 extending between bottom surfaces 28 and the respective associated ribs 24A-224D, and side surfaces 32 extending between bottom surfaces 28 and the outermost surface of ribs 24A-24E defined by the crown at 22. Ribs 24A-24E extend in a generally spiral path with respecto to the direction of rotation of drill bit 10. Junk slots 34 form a continuation of grooves 26 and are spaced around the outer peripheral surface 20 of drill bit 12 to form passages for the upward flow of drilling fluid and cuttings from the bore hole.

Each rib 24A-24E has a plurality of associated cutting elements mounted thereon with the cutting elements on each rib being arranged and positioned in generally the same manner. For that reason, only the cutting elements mounted on rib 24A will be described in detail and are designated as 36A, 36B, 36C, 36D, 36E, 36F, and 36G. Similar cutting elements on the remaining ribs are likewise designated successively from 36A.

A fluid discharge nozzle is provided for each of the ribs and designated 38A, 38B, 38C, 38D, and 38E for respective ribs 24A-24E. The positioning and functioning of each nozzle and the associated cutting elements are generally identical and for the purpose of illustration, only nozzle 38A and associated cutting elements 36A-36G on rib 24A will be explained in detail, it being understood that the remaining discharge nozzles and associated cutting elements are similarly positioned.

Cutting elements 36A-36G are staggered rearwardly in successive order with respect to the direction of rotation of drill bit 10. Thus, each cutting element from element 36A to cutting element 36G is spaced progressively farther from the associated nozzle 38A. Cutting elements 36A-36G are also spaced radially outwardly from each other. Cutting element 36G along with cutting element 36F are both positioned adjacent the outer periphery of bit body 12. Each PDC cutting element 36A-36G is substantially identical and as shown particularly in FIG. 4, cutting element 36B comprises a stud 40 preferably formed of a hardened tungsten carbide material. Stud 40 fits within an opening 42 in rib 24A and is secured therein by an interference fit or by brazing, for example. Stud 40 has a tapered outer surface as shown at 44 in FIG. 2 and a planar leading surface 46 on which a generally cylindrical disc 48 is secured, such as by brazing. Disc 48 includes a base 50 formed of tungsten carbide, for example and having a cutting face 53 thereon defined by an outer diamond layer at 54. A lower arcuate surface 55 is defined by disc 48 and a cutting edge 56 is formed at the juncture of planar face 53 and arcuate surface 55. Disc 48 with the diamond face and tungsten carbide base, as well known in the art, is manufactured by the Speciality Material Department of General Electric Company at Worthington, Ohio and sold under the trademark "Stratapax".

As shown in FIG. 4, it is desirable that disc 50 have a negative rake or be inclined with respect to the direction of rotation of drill bit 10. A negative angle N of around twenty (20) degrees has been found to be satisfactory for most formations encountered. It is believed that a negative rake of between around five (5) degrees and around thirty-five (35) degrees will function adequate for a polycrystalline diamond face or a natural diamond face.

Fluid discharge nozzle 38A is formed of a tungsten carbide material and is externally threaded at 51 for being screwed within an internally threaded opening 52. Openings 57 in the face of nozzle 38A as shown in FIGS. 2 and 3 are adapted to receive a suitable tool for securing nozzle 38A within threaded opening 52 for abutting engagement with annular shoulder 58. A resilient O-ring 59 is provided between nozzle 38A and bit body 12.

Nozzle 38A defines a fluid discharge orifice 60 which may be circular or oval in shape to provide a laterally divergent stream or jet of fluid shown generally at 62. The centerline of the jet of fluid being discharged from orifice 60 is shown at 64 and the perimeter of the area of fluid impingement against the bore hole bottom illustrated at 66 is shown at 68 as illustrated particularly by FIG. 3. The area of impingement 68 is ahead of cutting elements 36A–36G with respect to the rotation of drill bit 10. After the fluid impinges or strikes well bore bottom 66, the major flow of drilling fluid is along the well bore bottom in a direction generally perpendicular or normal to the direction of rotation and to the planar cutting faces 53 of cutting elements 36A–36G. This causes the high energy fluid to impinge and clean cutting faces 53. Also, after impingement against well bore bottom 66, the fluid stream fans or diverges outwardly toward the periphery 20 of drill bit body 12 so that the cutting elements 36A–36G have their cutting faces 53 cleaned with the drilling fluid flowing opposite the direction of rotation of bit 10. The flow of fluid then continues along grooves 26 and then upwardly along junk slots 34 along with the cuttings.

By impinging bore hole bottom 66 immediately ahead of cutting elements 36A–36G the bottom is flushed or cleaned of cuttings from the drilling operation immediately before the cutting operation. Further, since only a small number of nozzles, such as five, for example, are utilized, a relatively high velocity of drilling fluid at a relatively high pressure is discharged from orifices 60 to provide an efficient scouring and flushing of the well bore bottom 66 immediately ahead of the cutting elements and to cause a high energy fluid to impinge the faces of the cutting elements. For best results and to permit discharge orifices 60 to be of a relatively large size so that clogging of the orifices is minimized, it has been found that the number of discharge nozzles should be limited to around eight or less and that each discharge nozzle should be associated with at least four (4) spaced cutting elements and as many as around ten (10) cutting elements.

An important feature of the discharge nozzles is in directing the stream of fluid against the direction of rotation in order to provide after initial impingement of bottom 66 a desired high velocity flow of drilling fluid along bore hole bottom 66 against the cutting faces 53 of cutting elements 36A–36G. The stream or jet of drilling fluid must be directed against the direction of rotation of drill bit 10 to provide a flow of pressurized fluid for scouring the bottom immediately ahead of the cutting elements and to provide adequate cleaning and cooling action along the faces 53 of the cutting elements. Referring particularly to FIG. 4, an angle indicated at A is formed between the centerline 64 of the jet of fluid discharged from orifice 60 and the bore hole bottom 66 in a direction opposite the direction of rotation of the bit to provide a maximum utilization of fluid energy and dispersion of the fluid after impingement as it flows along the well bore bottom toward the faces of the cutting elements 36. An angle A of around forty-five (45) degrees has been found optimum with an optimum range between thirty (30) and sixty (60) degrees under most operating conditions for best results. However, it is believed that under various operating conditions, an angle A of between around fifteen (15) degrees to seventy-five (75) degrees would function satisfactory, depending on such factors for example as the size and type of bit, the number of discharge orifices, the number of cutting elements covered by a single discharge nozzle, and the type of formation encountered.

Any reference in the specification and claims herein to the centerline of the jet or stream of drilling fluid being discharged from a nozzle or orifice and impinging the bore hole bottom at an angle shall be interpreted as referring to angle A which represents the angle that the centerline of the volume of the discharged fluid stream from orifice 60 makes with the well bore hole bottom 66 in a direction opposite the direction of rotation of the bit.

From the above arrangement of cutting elements and discharge nozzles an improved flow of drilling fluid against the cutting elements has been provided resulting in a highly effective cleaning and cooling of the cutting elements as well as a scouring or cleaning of the bore hole bottom immediately prior to engagement of the formation by the cutting elements thus resulting in an increased rate of penetration.

While preferred embodiments to the present invention have been illustrated in detail, it is apparent that modification and adaptation of the preferred embodiment will occur to those skilled in the art. However, it is to be expressly understood that such modification or adaptations are within the spirit and scope of the present invention as set forth in the following claims.

What is claimed is:

1. A drag type drill bit for use in drilling well bore comprising:

a generally cylindrical bit body having a threaded pin at its upper end adapted to be detachably secured to a drill string for rotating the drill bit and for providing fluid under pressure to the bit, a cutter head at the lower end of the bit body, and a fluid passage therein extending from the pin down to the cutter head for delivery of the fluid under pressure from the drill string to the bottom of the bit;

cutting elements mounted on the cutter head, each having a planar cutter face and projecting downwardly from the head to a cutting edge engageable with the well bore bottom, with the cutting edge extending generally in a radial direction from the axis of rotation of the drill bit, said elements being positioned on the cutter head in a plurality of rows;

a plurality of nozzles on the head in flow communication with the fluid passage, with at least one nozzle being associated with each row of cutting elements and positioned ahead of the respective row in the direction of rotation of the bit, each nozzle for a respective row directing the fluid under pressure to flow opposite the direction of rotation of the bit and in a downward, conical flow pattern stream to an area of impingement on the well bore bottom ahead of the respective row of cutting elements, with the fluid flowing from the area of impingement in a lateral divergent stream generally normal to the cutting faces of the cutting elements and impinging substantially all of the cutting elements of the row, whereby the portion of the well bore bottom immediately in the path of the cutting elements is cleaned of cuttings, and the cutting elements are thereafter washed clean of cuttings and adequately cooled by the stream of drilling fluid as the cuttings are formed, for enhanced drill bit rates of drilling penetration.

2. The drill bit as set forth in claim 1 wherein the cutting elements of each row are arranged along a curved line on the cutter head.

3. The drill bit as set forth in claim 2 wherein the curved line is a segment of a spiral on the cutter head emanating from adjacent the axis of rotation thereof.

4. The drill bit of claim 2 wherein the curved line extends in the direction opposite to the direction of rotation of the bit.

5. The drill bit as set forth in claim 1 wherein the lateral stream of driling fluid flowing from the area of impingement on the well bore bottom impinges all of the cutting elements of the respective row.

6. The drill bit as set forth in claim 1 wherein each cutting element comprises a support member of wear resistant metal extending from the cutter head and carrying a layer of diamond material at the cutting face thereof.

7. The drill bit as set forth in claim 6 wherein the layer of diamong material is in the form of a disc mounted on the support member and presenting a generally arcuate cutting edge.

8. The drill bit of claim 1 wherein the centerline of each downward stream fo drilling fluid emanating from a nozzle for a respective row impinges the well bore bottom at a point spaced from the respective row in the direction of rotation of the drill bit.

9. The drill bit of claim 1 wherein the cutting elements for each row are radially spaced between an innermost cutting element and an outermost cutting element, and the upward stream of drilling fluid from the area of impingement on the well bore bottom does not diverge substantially beyond the innermost and outermost cutting elements of the respective row prior to impinging said cutting elements.

10. The drill bit as set forth in claim 1 wherein a single nozzle is provided for each row of said rows of cutting elements.

11. In a drag type drill bit having a generally cylindrical bit body with a fluid passage therein and defining an outer face, said bit body adapted to be connected to a drill string for rotation and to receive drilling fluid therefrom; improved cutting elements and fluid discharge orifices positioned on the outer face of the generally cylindrical bit body comprising:

a plurality of cutting elements positioned on the face of the bit body in a plurality of rows with the cutting elements of each row radially spaced successively outwardly from the axis of rotation of the drill bit;

at least one nozzle associated with each row of cutting elements and providing drilling fluid for a plurality of associated cutting elements, each nozzle with respect to the direction of rotation being positioned ahead of its associated row and directing drilling fluid in a downward conical flow stream with the center of the fluid stream impinging against the well bore bottom ahead of most of the cutting elements in the associated row and being directed against the rotation of the bit, with the fluid flowing from the area of impingement against the well bore bottom in a lateral divergent stream generally along the bottom of the well bore and in a direction generally normal to the cutting faces of most of the cutting elements for impinging all of the plurality of associated cutting elements, whereby the well bore bottom immediately in the path of the associated cutting elements is cleaned of cuttings,a nd the cutting elements are thereafter washed clean of cuttings and adequately cooled by the stream of drilling fluid as the cuttings are formed, for enhanced drill bit rates of drilling penetration.

12. A rotary drill bit of the drag type comprising;

a bit body having a fluid passage therein and defining an outer periheral surface, said bit body adapted to be connected to a drill string for rotation therewith and to receive drilling fluid therefrom;

a plurality of rows of cutting elements mounted on said bit body, each row containing a plurality of cutting elements arranged along a path leading from the longitudinal axis of rotation to the outer peripheral surface of the bit body, the plurality of cutting elements in each row radially spaced successively from each other; and a fluid discharge nozzle associated with each row of cutting elements and positioned ahead of the associated row in the direction of rotation of the bit, each nozzle forming a discharge orifice directing the fluid in a downward conical flow stream, the centerline of the discharge stream impinging the well bore bottom ahead of the associated row of cutting elements with the fluid flowing from the area of impingement generally along the bottom of the bore hole in a direction against the rotation and toward the cutting faces of the cutting elements for impinging substantially all of the cutting elements in the associated row and substantially cleaning the well bore bottom of cuttings immediately in the path of the associated cutting elements, said centerline of the discharged stream impinging the bore hole bottom at an angle of between around fifteen degrees and seventy-five degrees.

13. A rotary drill bit as set forth in claim 12 wherein the cutting elements in each row are positioned successively rearwardly of each other to form a spiral row extending outwardly from the axis of rotation.

14. A rotary drill bit as set forth in claim 12 wherein the flow of drilling fluid from the area of impingement on the well bore bottom does not diverge substantially beyond the innermost and outermost cutting elements of the associated row prior to impinging said cutting elements.

15. A rotary drill bit as set forth in claim 12 wherein each fluid discharge nozzle is associated with at least four cutting elements and the centerline of the discharged stream is opposed to the direction of rotation of the bit at an angle between around thirty degrees and sixty degrees relative to the bore hole bottom.

* * * * *